US011215356B2

(12) United States Patent
Takeda et al.

(10) Patent No.: US 11,215,356 B2
(45) Date of Patent: Jan. 4, 2022

(54) NI-BASED ALLOY PIPE FOR NUCLEAR POWER

(71) Applicant: NIPPON STEEL CORPORATION, Tokyo (JP)

(72) Inventors: Kiyoko Takeda, Tokyo (JP); Hirokazu Okada, Tokyo (JP); Osamu Miyahara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 46 days.

(21) Appl. No.: 16/619,882

(22) PCT Filed: Jun. 7, 2018

(86) PCT No.: PCT/JP2018/021909
§ 371 (c)(1),
(2) Date: Dec. 5, 2019

(87) PCT Pub. No.: WO2018/225831
PCT Pub. Date: Dec. 13, 2018

(65) Prior Publication Data

US 2020/0158329 A1 May 21, 2020

(30) Foreign Application Priority Data

Jun. 8, 2017 (JP) ..... JP2017-113327

(51) Int. Cl.

| | |
|---|---|
| ***C22C 19/05*** | (2006.01) |
| ***F16L 9/02*** | (2006.01) |
| ***F22B 37/04*** | (2006.01) |
| ***C22F 1/10*** | (2006.01) |

(52) U.S. Cl.
CPC ..... *F22B 37/04* (2013.01); *C22C 19/053* (2013.01); *C22C 19/055* (2013.01); *C22F 1/10* (2013.01)

(58) Field of Classification Search
None
See application file for complete search history.

(56) References Cited

U.S. PATENT DOCUMENTS

| | | | | |
|---|---|---|---|---|
| 5,378,427 | A * | 1/1995 | Otsuka | C22C 30/00 148/909 |
| 8,246,766 | B2 * | 8/2012 | Yokoyama | C22F 1/10 148/556 |
| 2011/0183151 | A1 | 7/2011 | Yokoyama et al. | |
| 2013/0118420 | A1 | 5/2013 | Toyoda et al. | |
| 2017/0298478 | A1 | 10/2017 | Masaki et al. | |
| 2018/0163285 | A1 | 6/2018 | Takeda et al. | |

FOREIGN PATENT DOCUMENTS

| | | | |
|---|---|---|---|
| EP | 1717330 | A1 | 11/2006 |
| JP | 7-252564 | A | 10/1995 |
| JP | 10-121170 | A | 5/1998 |
| JP | 2014-146702 | A | 8/2014 |
| WO | WO 2005/078148 | A1 | 8/2005 |
| WO | WO 2009/142228 | A1 | 11/2009 |
| WO | WO 2012/001882 | A1 | 1/2012 |
| WO | WO 2012/121390 | A1 | 9/2012 |
| WO | WO 2016/052551 | A1 | 4/2016 |
| WO | WO 2016/208569 | A1 | 12/2016 |

OTHER PUBLICATIONS

International Preliminary Report on Patentability, dated Dec. 19, 2019 and Written Opinion of the International Searching Authority, dated Sep. 11, 2018, for International Application No. PCT/JP2018/021909, with an English translation of the Written Opinion.
International Search Report, dated Sep. 11, 2018, for International Application No. PCT/JP2018/021909, with an English translation.

* cited by examiner

*Primary Examiner* — Adam Krupicka
(74) *Attorney, Agent, or Firm* — Birch, Stewart, Kolasch & Birch, LLP

(57) ABSTRACT

An Ni-based alloy pipe for nuclear power has a chemical composition consisting of, in mass percent: C: 0.015 to 0.030%, Si: 0.10 to 0.50%, Mn: 0.10 to 0.50%, P: 0.040% or less, S: 0.015% or less, Cu: 0.01 to 0.20%, Ni: 50.0 to 65.0%, Cr: 19.0 to 35.0%, Mo: 0 to 0.40%, Co: 0.040% or less, Al: 0.30% or less, N: 0.010 to 0.080%, Ti: 0.020 to 0.180%, Zr: 0.010% or less, and Nb: 0.060% or less, the balance: Fe and impurities, and satisfying $[(N-Ti\times14/48)\times d^3\geq4000]$ in relation to an average grain diameter, wherein a standard deviation of grain diameters is 20 μm or less, and a hardness of insides of grains is 180 HV or more.

4 Claims, No Drawings

NI-BASED ALLOY PIPE FOR NUCLEAR POWER

TECHNICAL FIELD

The present invention relates to an Ni-based alloy pipe for nuclear power.

BACKGROUND ART

Ni-based alloys are excellent in mechanical properties and thus used for various kinds of members. In particular, the Ni-based alloys, which are excellent in corrosion resistance, are used for members of a nuclear reactor because the members are exposed to high-temperature water. For example, 60% Ni-30% Cr-10% Fe alloy or the like is used for members of a steam generator of a pressurized water reactor (PWR).

In recent years, Ni-based alloys have been required to have a further increased strength to meet a demand for reduction in size and weight of members for nuclear power.

For example, Patent Document 1 discloses a high Cr—Ni-based alloy member excellent in corrosion resistance and strength. In addition, for a high-strength Ni-based alloy pipe for nuclear power, Patent Document 2 discloses an Ni-based alloy pipe having a high temperature strength uniform over an entire length of the pipe and a method for producing the Ni-based alloy pipe.

LIST OF PRIOR ART DOCUMENTS

Patent Document

Patent Document 1: JP07-252564A
Patent Document 2: WO 2009/142228

SUMMARY OF INVENTION

Technical Problem

It is however cannot be said that the technique described in Patent Document 1 provides a sufficient strength, and there is a room for improvement. Moreover, the technique described in Patent Document 2 involves a secondary melting method for increasing the strength, and thus there is a room for improvement in economic efficiency.

An objective of the present invention is to provide an Ni-based alloy pipe for nuclear power that is excellent in economic efficiency, has a good ductility, and has a high strength.

Solution to Problem

The present invention is made to solve the problems described above, and the gist of the present invention is the following Ni-based alloy pipe for nuclear power.

(1) An Ni-based alloy pipe for nuclear power, having a chemical composition consisting of, in mass percent:

C: 0.015 to 0.030%,
Si: 0.10 to 0.50%,
Mn: 0.10 to 0.50%,
P: 0.040% or less,
S: 0.015% or less,
Cu: 0.01 to 0.20%,
Ni: 50.0 to 65.0%,
Cr: 19.0 to 35.0%,
Mo: 0 to 0.40%, Co: 0.040% or less,
Al: 0.30% or less,
N: 0.010 to 0.080%,
Ti: 0.020 to 0.180%,
Zr: 0.010% or less,
Nb: 0.060% or less,
the balance: Fe and impurities, and satisfying Formula (i) in relation to an average grain diameter, wherein a standard deviation of grain diameters is 20 μm or less, and a hardness of insides of grains is 180 HV or more.

$$(N-Ti\times 14/48)\times d^3 \geq 4000 \quad \text{(i)}$$

where meanings of symbols in the above formula are as follows.

N: an N content in the alloy (mass %)
Ti: a Ti content in the alloy (mass %)
d: Average grain diameter (μm)

(2) The Ni-based alloy pipe for nuclear power according to the above (1), wherein the Ni-based alloy pipe has an outer diameter of 8 to 25 mm and a wall thickness of 0.6 to 2 mm.

Advantageous Effects of Invention

According to the present invention, an Ni-based alloy pipe for nuclear power having excellent mechanical properties.

DESCRIPTION OF EMBODIMENTS

The present inventors conducted intensive studies about how to obtain an Ni-based alloy pipe for nuclear power that is excellent in economic efficiency, has a good ductility, and has a high strength, and consequently obtained the following findings.

By leveraging, in addition to precipitation strengthening by precipitates such as carbo-nitrides, solid-solution strengthening by N, a further increase in strength of the alloy pipe can be achieved. It is therefore necessary to keep a prescribed amount of dissolved N In addition, if variations in grain diameter are large, the variations cause a decrease in strength, and thus grains are required to have sizes that are made as uniform as possible. Here, to improve the economic efficiency, it is desirable to produce the alloy pipe without performing secondary melting, which leads to an increase in costs. However, in a case where the secondary melting is not performed, the precipitates used in the precipitation strengthening results in segregation of the grains, which rather causes a decrease in strength.

Possible elements contributing to the precipitation strengthening include Ti (titanium), Zr (zirconium), and Nb (niobium), but Zr and Nb tend to produce variations in grain sizes as compared with Ti. Accordingly, only Ti is added as a precipitation strengthening element, and Zr and Nb are not to be added positively.

In addition, by performing cold working in a producing process, structures that are uniform in grain diameter can be formed without performing the secondary melting.

The present invention is made based on the findings described above. Requirements of the present invention will be described below in detail.

1. Chemical Composition.

The reasons for limiting contents of elements are as described below. In the following description, the symbol "%" for contents means "percent by mass."

C: 0.015 to 0.030%

C (carbon) is an element necessary for ensuring strength. However, if a C content is more than 0.030%, carbides precipitating in grain boundaries increase, resulting in a degradation in intergranular corrosion resistance. Accordingly, the C content is set at 0.015 to 0.030%. The C content is preferably 0.017% or more and preferably 0.025% or less.

Si: 0.10 to 0.50%

Si (silicon) is an element used for deoxidation. If an Si content is less than 0.10%, the deoxidation becomes poor. However, if the Si content is more than 0.50%, formation of inclusions is facilitated. Accordingly, the Si content is set at 0.10 to 0.50%. The Si content is preferably 0.15% or more and preferably 0.30% or less.

Mn: 0.10 to 0.50%

Mn (manganese) is an element used for deoxidation. In addition, by forming MnS, Mn has an effect of immobilizing S (sulfur), which degrades weldability and hot workability. If an Mn content is less than 0.10%, this effect cannot be obtained sufficiently. However, if the Mn content is more than 0.50%, a cleanliness of the alloy decreases. In addition, if MnS is present excessively in the alloy, the MnS decreases corrosion resistance. Accordingly, the Mn content is set at 0.10 to 0.50%. The Mn content is preferably 0.12% or more and preferably 0.40% or less.

P: 0.040% or Less

P (phosphorus) is contained in the alloy as an impurity and segregates in grain boundaries of a weld heat affected zone (HAZ) to contribute to an increase in weld cracking susceptibility. Accordingly, a P content is set at 0.040% or less. The P content is preferably 0.030% or less, and more preferably 0.020% or less.

S: 0.015% or Less

S (sulfur) is contained in the alloy as an impurity, and not only results in a deterioration in hot workability at high temperature but also segregates in grain boundaries of a weld heat affected zone (HAZ) to degrade workability and weldability. Accordingly, an S content is set at 0.015% or less. The S content is preferably 0.010% or less, and more preferably 0.005% or less.

Cu: 0.01 to 0.20%

Being contained in the alloy in a minute quantity, Cu (copper) has an effect of increasing corrosion resistance. However, if Cu is contained excessively in a nuclear reactor structural material, Cu is eluted in reactor water and adhered to a fuel cladding in a form of a corrosion product when the nuclear reactor structural material corrodes, and the corrosion product can accelerate corrosion of the fuel cladding, leading to breakage of the fuel cladding. Accordingly, a Cu content is set at 0.01 to 0.20%. The Cu content is preferably 0.15% or less, and more preferably 0.10% or less.

Ni: 50.0 to 65.0%

Ni (nickel) is an element that has an effect of increasing a corrosion resistance of the alloy. In a nuclear reactor water environment at high temperature, prevention of stress corrosion cracking is particularly essential. Meanwhile, an upper limit of Ni is determined with interaction between Ni and other elements such as Cr, Mn, P, and S taken into consideration. Accordingly, an Ni content is set at 50.0 to 65.0%. The Ni content is preferably 55.0% or more, and more preferably 58.0% or more. In addition, the Ni content is preferably 63.0% or less, and more preferably 61.5% or less.

Cr: 19.0 to 35.0%

Cr (chromium) is an element that has an effect of increasing a corrosion resistance of the alloy. In a nuclear reactor water environment at high temperature, prevention of stress corrosion cracking is particularly essential. Meanwhile, an upper limit of Cr is determined with the Ni content, a primary element, taken into consideration. Accordingly, a Cr content is set at 19.0 to 35.0%. The Cr content is preferably 23.0% or more, and more preferably 27.0% or more. In addition, the Cr content is preferably 33.0% or less, and more preferably 31.0% or less.

Mo: 0 to 0.40%

Mo (molybdenum) has an effect of improving a corrosion resistance of the alloy, and therefore Mo may be contained as needed. For an Ni-based alloy for nuclear power, there is a case where $M_{23}C_6$ is positively caused to precipitate in grain boundaries in TT treatment described below, and Mo has an effect of restraining the precipitation of $M_{23}C_6$. Accordingly, an Mo content is set at 0.40% or less. The Mo content is preferably 0.15% or less, and more preferably 0.07% or less. When the intention is to obtain the effect, the Mo content is preferably 0.02% or more.

Co: 0.040% or Less

Co (cobalt) is an impurity. In a case where Co is contained in a nuclear reactor structural material, when Co is eluted in reactor water through corrosion of the nuclear reactor structural material and is radioactivated at a reactor core, Co is converted to a radioisotope having a long half-life. As a result, a regular inspection cannot be undertaken until an amount of emitted radiation decreases to a proper value, which prolongs a period of the regular inspection and produces an economic loss. Accordingly, a Co content is desirably made as low as possible and set at 0.040% or less. The Co content is preferably 0.030% or less, and more preferably 0.020% or less. Although the Co content is desirably made as low as possible, Co is inevitably mixed in as an impurity in a real operation, and a use of a raw material of high purity results in high costs. Accordingly, the Co content is preferably 0.005% or more.

Al: 0.30% or Less

Al (aluminum) is used for deoxidation and remains in the alloy as an impurity. If an Al content is more than 0.30%, formation of inclusions is facilitated. Accordingly, the Al content is set at 0.30% or less. The Al content is preferably 0.25% or less, and more preferably 0.20% or less. An extreme reduction of the Al content leads to an increase in costs, and thus the Al content is preferably 0.005% or more.

N: 0.010 to 0.080%

N (nitrogen) combines with Ti (titanium), Zr (zirconium), and C (carbon) to form their carbo-nitrides, increasing a strength of the alloy. In addition, N not contributing to the formation of the carbo-nitrides but being dissolved in parent phases has an effect of increasing the strength. To increase the strength of the alloy, an N content needs to be set at 0.010% or more. In contrast, if the N content is more than 0.080%, an amount of the dissolved N becomes excessive, which increases deformation resistance at high temperature and degrades hot workability. Accordingly, the N content is set at 0.010 to 0.080%. The N content is preferably 0.025% or more, and more preferably 0.030% or more. The N content is preferably 0.06% or less.

Ti: 0.020 to 0.180%

Ti (titanium) is an element to be contained to improve hot workability and combines with N to form its nitride. The Ti nitride dispersed finely in the alloy has an effect of increasing a strength of the alloy. In contrast, an excessive precipitation of the nitride causes segregation, which requires secondary melting, and results in an increase in costs. Accordingly, a Ti content is set at 0.020 to 0.180%. The Ti content is preferably 0.025% or more, more preferably 0.040% or more. In addition, the Ti content is preferably 0.150% or less, and more preferably 0.130% or less.

Zr: 0.010% or Less

Nb: 0.060% or Less

As with Ti, Zr (zirconium) and Nb (niobium) form their nitrides to contribute to an increase in strength of the alloy. However, these elements contained in the alloy causes large variations in grain diameter, rather decreasing the strength of the alloy, and thus Zr and Nb are not added positively. Accordingly, a Zr content is set at 0.010% or less, and an Nb content is set at 0.060% or less. The Zr content is preferably 0.008% or less, and more preferably 0.005% or less. The Nb content is preferably 0.040% or less, and more preferably 0.020% or less.

$$(N-Ti\times 14/48)\times d^3 \geq 4000 \quad \text{(i)}$$

where meanings of symbols in the above formula are as follows.

N: the N content in the alloy (mass %)

Ti: the Ti content in the alloy (mass %)

d: Average grain diameter (μm)

Formula (i) reflects an in-grain concentration of the dissolved N. Letting d denote the average grain diameter, a number of grains per unit volume is proportional to $1/d^3$. Assuming that all of N in the steel combines with Ti to precipitate in a form of TiN, an amount of the dissolved N is calculated as $N-Ti\times 14/48$, and the amount of the dissolved N per unit volume is expressed as $(N-Ti\times 14/48)\times 1\times D$. Here, D denotes a density of the material. An amount of the dissolved N contained in each grain is expressed as $(N-Ti\times 14/48)\times 1\times D+(1/d^3)$, and the amount of the dissolved N contained in each grain has a correlation with $(N-Ti\times 14/48)\div(1/d^3)$ because D is a constant.

Of the material according to the present invention, the balance is Fe and impurities. The term "impurities" used herein means components that are mixed in the alloy in producing the alloy industrially from raw materials such as ores and scraps due to various causes lying in the producing process and that are allowed to be mixed in the alloy within ranges in which the impurities have no adverse effect on the present invention.

2. Grains

Standard deviation of grain diameters: 20 μm or less.

To increase the strength of the alloy as described above, it is necessary to equalize sizes of grains to keep variations in grain diameter small. Accordingly, a standard deviation of the grain diameters is set at 20 μm or less. The standard deviation of the grain diameters is preferably 15 μm or less, and more preferably 10 μm or less.

Average Grain Diameter: 30 to 85 μm

The average grain diameter is not limited to a particular value, but the grains are preferably made fine to increase the strength of the alloy. Accordingly, the average grain diameter is preferably 85 μm or less. In contrast, if the grains are made excessively fine, the strength is increased, but ductility decreases, and thus the average grain diameter is preferably 30 μm or more.

Hardness of Insides of Grains: 180 HV or More

In the present invention, the strength of the alloy is enhanced by leveraging the solid-solution strengthening by N. A hardness of insides of grains of less than 180 HV means that the solid-solution strengthening by N is insufficient, and a required strength cannot be obtained. Accordingly, the hardness of the insides of the grains is set at 180 HV or more.

In the present invention, the average value and the standard deviation of the grain diameters, and the hardness of the insides of the grains are to be determined by the following method. First, a specimen is cut out such that an observation surface of the specimen is a cross section of an alloy pipe perpendicular to a longitudinal direction of the alloy pipe, and the specimen is embedded in an epoxy resin. The observation surface is then subjected to wet polishing with 1000-grit emery paper then to buffing, and additionally etched with mixed acid. In the observation surface, five fields are then observed under an optical microscope at 100× magnification, and measurement of the grain diameter is performed on a total of 100 or more grains. Each of the grain diameters is calculated as an average value of a maximum length and a minimum length of each grain. From the results, the average value and the standard deviation of the grain diameters are determined.

In addition, using a specimen obtained through the same procedure as described above, a micro-Vickers hardness of insides of grains is measured. At this time, a test force is set at 25 gf.

3. Dimensions

The alloy pipe according to the present invention is used as a member for nuclear power. Considering that the alloy pipe is used as such, an outer diameter of the alloy pipe is preferably 8 to 25 mm. In addition, to achieve the reduction in size and weight of the member as described above, a wall thickness of the alloy pipe is preferably 0.6 to 2 mm.

4. Producing Method

The Ni-based alloy pipe for nuclear power according to the present invention can be produced by, for example, the following method. First, an alloy having the above chemical composition is melted and subjected to hot forging into a billet. From the viewpoint of economic efficiency, refinement is performed once, and secondary melting is not performed. Subsequently, the billet is subjected to hot working and cold working to be formed in a tubular shape.

Subsequently, the alloy pipe is subjected to intermediate heat treatment to be softened and subjected to cold working to have predetermined dimensions. Here, by performing final cold working, the variations in grain diameter can be reduced, and uniform metal micro-structures can be formed.

In addition, the above alloy pipe is subjected to heat treatment (heating) in a temperature range from 1030 to 1130° C. for 15 min or less, then water-cooled or air-cooled, further subjected to heat treatment at a temperature of 680 to 780° C. for 5 to 15 h, and air-cooled. Conditions of the above heat treatment will be described below in detail.

First, to keep a high corrosion resistance while keeping a high strength, the alloy is subjected to solution treatment. In the solution treatment, a heating temperature is preferably set within a temperature range from 1030 to 1130° C. If the heating temperature is less than 1030° C., C is not dissolved sufficiently, which makes it difficult to obtain the above effects. In contrast, if the heating temperature is more than 1130° C., the above effects plateau out, and grains coarsen, decreasing a strength of the material, which makes the alloy unsuitable for a member for nuclear power. In addition, a heating time period in the solution treatment is preferably set at 15 min or less. If the heating time period is more than 15 min, the above effects plateau out.

The cooling treatment using water cooling means or air cooling means in the solution treatment can be performed using a well-known apparatus or the like, but it is preferable that a cooling rate at this time is a cooling rate higher than that of a normal air cooling condition, that is, under a condition of accelerated cooling, from the viewpoint of keeping strength and corrosion resistance.

Next, the alloy subjected to the solution treatment is subjected to aging treatment. In the aging treatment, a heating temperature is preferably set within a temperature range from 680 to 780° C. If the heating temperature is less than 680° C., it takes a long time for the $M_{23}C_6$ carbides, which is necessary to enhance corrosion resistance, to precipitate, which makes it difficult to obtain an effect of the aging heat treatment. In contrast, if the heating temperature is more than 780° C., the effect plateaus out.

In addition, a heating time period in the aging treatment is preferably set at 5 to 15 h. If the heating time period is less than 5 h, there is a risk that the precipitation of the $M_{23}C_6$ carbides, which is necessary to enhance corrosion resistance, is insufficient. In contrast, if the heating time period is more than 15 h, the above effect plateaus out, and in the alloy having the above composition, in which the Cr content is high, brittle phases such as an a phase precipitates, decreasing mechanical properties.

The present invention will be described more specifically below with reference to examples, but the present invention is not limited to these examples.

EXAMPLE

Alloys having chemical compositions shown in Table 1 were molted by the vacuum melting method and subjected to hot forging into billets. The billets were machined to be hollow and additionally subjected to hot working and cold working to have a small diameter. Then, the billets were subjected to the intermediate heat treatment to be softened, subjected to cold working into pipes having an outer diameter of 20 mm and a thickness of 1 mm. These pipes were subjected to the solution treatment that performs the heat treatment of holding the pipes at 1080° C. for 10 min and then water-cooling, then subjected the allowing cooling that performs the heat treatment of holding the pipes at 700° C. for 15 h and then allowing cooling, by which test materials were obtained. Note that in Test No. 12, no cold working was performed and only the hot working was performed.

TABLE 1

| Alloy | Chemical composition (mass %, balance: Fe and impurities) | | | | | | | | | | | | | | |
|---|---|---|---|---|---|---|---|---|---|---|---|---|---|---|---|
| No. | C | Si | Mn | P | S | Cu | Ni | Cr | Mo | Ti | Nb | Zr | Al | Co | N |
| 1 | 0.018 | 0.30 | 0.34 | 0.0015 | 0.0008 | 0.08 | 58.3 | 29.8 | 0.06 | 0.030 | — | — | 0.05 | 0.011 | 0.035 |
| 2 | 0.019 | 0.25 | 0.33 | 0.0018 | 0.0009 | 0.06 | 59.4 | 30.2 | — | 0.135 | 0.04 | — | 0.10 | 0.016 | 0.080 |
| 3 | 0.021 | 0.31 | 0.33 | 0.0012 | 0.0011 | 0.10 | 59.8 | 28.6 | 0.04 | 0.050 | 0.01 | 0.002 | 0.12 | 0.021 | 0.035 |
| 4 | 0.016 | 0.28 | 0.30 | 0.0013 | 0.0010 | 0.04 | 60.7 | 29.5 | 0.02 | 0.080 | — | 0.004 | 0.08 | 0.020 | 0.035 |
| 5 | 0.023 | 0.31 | 0.32 | 0.0015 | 0.0010 | 0.08 | 62.3 | 31.3 | 0.08 | 0.250 | — | — | 0.15 | 0.015 | 0.005 |
| 6 | 0.020 | 0.30 | 0.34 | 0.0016 | 0.0008 | 0.06 | 62.2 | 30.1 | — | 0.008 | — | — | 0.09 | 0.028 | 0.035 |
| 7 | 0.020 | 0.30 | 0.30 | 0.0015 | 0.0010 | 0.07 | 60.0 | 30.0 | 0.04 | 0.020 | — | 0.046 | 0.08 | 0.020 | 0.035 |
| 8 | 0.020 | 0.30 | 0.30 | 0.0015 | 0.0010 | 0.09 | 60.0 | 30.0 | 0.02 | 0.020 | 0.12 | — | 0.08 | 0.020 | 0.035 |
| 9 | 0.021 | 0.28 | 0.29 | 0.0019 | 0.0011 | 0.12 | 59.1 | 31.5 | 0.03 | 0.020 | — | — | 0.10 | 0.023 | 0.007 |
| 10 | 0.020 | 0.27 | 0.31 | 0.0017 | 0.0009 | 0.08 | 58.7 | 32.4 | — | 0.150 | — | — | 0.11 | 0.026 | 0.110 |
| 11 | 0.018 | 0.33 | 0.30 | 0.0015 | 0.0009 | 0.05 | 60.5 | 29.7 | 0.06 | 0.210 | — | — | 0.09 | 0.015 | 0.033 |
| 12 | 0.022 | 0.25 | 0.31 | 0.0012 | 0.0008 | 0.05 | 60.1 | 29.4 | 0.09 | 0.099 | — | — | 0.06 | 0.010 | 0.021 |

For each of the test materials, first, its average value and standard deviation of the grain diameter were measured. Specifically, a specimen was cut out from each test material such that an observation surface of the specimen was a cross section of the pipe perpendicular to a longitudinal direction of the pipe. The specimen was then embedded in an epoxy resin, and the observation surface was then subjected to wet polishing with 1000-grit emery paper then to buffing, and additionally etched with mixed acid. In the observation surface, five fields are then observed under an optical microscope at 100× magnification, and measurement of the grain diameter is performed on a total of 100 or more grains, and the average value and the standard deviation of the grain diameters were calculated. Results of the measurements are shown in Table 2.

TABLE 2

| Test No. | Alloy No. | Average grain diameter (μm) | Left side value of Formula (i) | Standard deviation (μm) | Hardness of insides of grains | YS (MPa) | TS (MPa) | EL (%) | |
|---|---|---|---|---|---|---|---|---|---|
| 1 | 1 | 64 | 6881 | 8.0 | 220 | 320 | 720 | 57 | Inventive |
| 2 | 2 | 70 | 13934 | 3.2 | 215 | 330 | 725 | 58 | example |
| 3 | 3 | 70 | 7003 | 3.2 | 230 | 350 | 725 | 57 | |
| 4 | 4 | 70 | 4002 | 3.2 | 180 | 345 | 710 | 54 | |
| 5 | 5 | 48 | −7511 | 7.5 | 140 | 292 | 672 | 56 | Comparative |
| 6 | 6 | 94 | 27132 | 9.7 | 210 | 305 | 685 | 54 | example |
| 7 | 7 | 61 | 6620 | 35.7 | — | — | — | — | |
| 8 | 8 | 64 | 7646 | 38.9 | — | — | — | — | |

TABLE 2-continued

| Test No. | Alloy No. | Average grain diameter (μm) | Left side value of Formula (i) | Standard deviation (μm) | Hardness of insides of grains | YS (MPa) | TS (MPa) | EL (%) |
|---|---|---|---|---|---|---|---|---|
| 9 | 9 | 88 | 784 | 5.7 | 140 | 267 | 675 | 60 |
| 10 | 10 | 78 | 30958 | 5.7 | 220 | 335 | 730 | 40 |
| 11 | 11 | 43 | −2246 | 20.6 | — | — | — | — |
| 12 | 12 | 96 | −6881 | 21.4 | — | — | — | — |

$(N—Ti \times 14/48) \times d^3 \geq 4000$ . . . (i)

Thereafter, only for each of the test materials having standard deviations of the grain diameters of 20 μm or less, its hardness of the insides of the grains was measured, and its tensile property was evaluated. The hardness of the insides of the grains was measured using the above specimens, as a micro-Vickers hardness at a test force of 25 gf.

The tensile property was evaluated by a tensile test at normal temperature in conformity to JIS Z 2241 (2011). Specifically, a 14C tensile test specimen, which is described in JIS Z 2241 (2011), was taken from each test material. At this time, the test specimen was taken such that a longitudinal direction of the tensile test specimen matches a longitudinal direction of the pipe.

The results are shown in Table 2 altogether. In the present invention, test specimens having a 0.2% proof stress (YS) of 310 MPa, a tensile strength (TS) of 700 MPa or more, and a rupture elongation (EL) is 50% were determined to be excellent in mechanical properties.

Referring to Tables 1 and 2, in each of Test Nos. 7 and 8, Zr or Nb was excessively contained, thus resulting in extremely large variations in grain diameter. In Test No. 11, its Ti content was excessive, and thus its precipitation amount of Ti carbo-nitrides was excessive, resulting in large variations in grain diameter. In Test No. 12, its variations in grain diameter were extremely large because of not performing the cold working.

In Test No. 5, because its Ti content was more than the specified value of the Ti content, and its N content was less than the specified value of the N content, the precipitation strengthening by the Ti carbo-nitrides and the solid-solution strengthening by N were insufficient, and thus Test No. 5 failed to obtain the required strength. In Test No. 6, because its Ti content was less than the specified value of the Ti content, the precipitation strengthening by the Ti carbo-nitrides was insufficient, and thus Test No. 6 failed to obtain the required strength. In Test No. 9, because its N content was less than the specified value of the N content, the solid-solution strengthening by N was insufficient, and thus Test No. 9 failed to obtain the required strength. In Test No. 10, because its N content was excessive, the solid-solution strengthening by N was excessive, resulting in a poor ductility.

In contrast to these Test Nos., Test Nos. 1 to 4, which satisfied all of the definition according to the present invention, showed results of having high strengths and excellent ductilities.

INDUSTRIAL APPLICABILITY

According to the present invention, an Ni-based alloy pipe for nuclear power having excellent mechanical properties. The Ni-based alloy pipe for nuclear power according to the present invention is suitable for a material of a heat-transfer pipe for steam generators used in high-temperature water.

The invention claimed is:

1. An Ni-based alloy pipe for nuclear power, having a chemical composition consisting of, in mass percent:

C: 0.015 to 0.030%,
Si: 0.10 to 0.50%,
Mn: 0.10 to 0.50%,
P: 0.040% or less,
S: 0.015% or less,
Cu: 0.01 to 0.20%,
Ni: 50.0 to 65.0%,
Cr: 19.0 to 35.0%,
Mo: 0 to 0.40%,
Co: 0.040% or less,
Al: 0.30% or less,
N: 0.010 to 0.080%,
Ti: 0.020 to 0.180%,
Zr: 0.010% or less,
Nb: 0.060% or less,
the balance: Fe and impurities, and
satisfying Formula (i) in relation to an average grain diameter, wherein
a standard deviation of grain diameters is 20 μm or less, and
a hardness of insides of grains is 180 HV or more;

$$(N-Ti\times 14/48)\times d^3 4000 \quad (i)$$

where meanings of symbols in the above formula are as follows,
N: an N content in the alloy (mass %)
Ti: a Ti content in the alloy (mass %)
d: Average grain diameter (μm).

2. The Ni-based alloy pipe for nuclear power according to claim 1, wherein the Ni-based alloy pipe has an outer diameter of 8 to 25 mm and a wall thickness of 0.6 to 2 mm.

3. An Ni-based alloy pipe for nuclear power, having a chemical composition comprising, in mass percent:

C: 0.015 to 0.030%,
Si: 0.10 to 0.50%,
Mn: 0.10 to 0.50%,
P: 0.040% or less,
S: 0.015% or less,
Cu: 0.01 to 0.20%,
Ni: 50.0 to 65.0%,
Cr: 19.0 to 35.0%,
Mo: 0 to 0.40%,
Co: 0.040% or less,
Al: 0.30% or less,
N: 0.010 to 0.080%,
Ti: 0.02.0 to 0.180%,
Zr: 0.010% or less,
Nb: 0.060% or less,
the balance: Fe and impurities, and
satisfying Formula (i) in relation to an average grain diameter, wherein a standard deviation of grain diameters is 20 μm or less, and a hardness of insides of grains is 180 HV or more;

$$(N-Ti\times 14/48)\times d^3 4000 \quad \text{(i)}$$

where meanings of symbols in the above formula are as follows,

N: an N content in the alloy (mass %)

Ti: a Ti content in the alloy (mass %)

d: Average grain diameter (μm).

4. The Ni-based alloy pipe for nuclear power according to claim 3, wherein the Ni-based alloy pipe has an outer diameter of 8 to 25 mm and a wall thickness of 0.6 to 2 mm.

* * * * *